US006520076B2

(12) United States Patent
Hong

(10) Patent No.: US 6,520,076 B2
(45) Date of Patent: Feb. 18, 2003

(54) OIL PRESSURE DEVICE

(76) Inventor: Wen-Cheng Hong, 10, Third Industry Rd., Ming Shung Shia, Gia Yi Hsien (TW)

( * ) Notice: Subject to any disclaimer, the term of this patent is extended or adjusted under 35 U.S.C. 154(b) by 140 days.

(21) Appl. No.: 09/770,047

(22) Filed: Jan. 25, 2001

(65) Prior Publication Data

US 2002/0096059 A1 Jul. 25, 2002

(51) Int. Cl.[7] ..... B30B 1/32

(52) U.S. Cl. ..... 100/269.14; 60/301; 91/224; 137/87.01; 100/269.18

(58) Field of Search ..... 60/301; 91/224, 91/321; 137/87.01; 100/269.14, 269.15, 269.16, 269.18; 417/401; 418/DIG. 1

(56) References Cited

U.S. PATENT DOCUMENTS 3,456,297 A * 7/1969 Andreasson ..... 100/269.18
5,449,051 A * 9/1995 Liao ..... 137/87.1 X
6,415,704 B1 * 7/2002 Wang ..... 91/224

* cited by examiner

*Primary Examiner*—W. Donald Bray
(74) *Attorney, Agent, or Firm*—Alan Kamrath; Rider, Bennett, Egan & Arundel , LLP

(57) ABSTRACT

An oil pressure device is disposed on a hoist frame. The hoist frame has an upper panel and a middle panel. An oil cylinder is disposed on the upper panel. The oil pressure device has a pneumatic pump having a lower cover and a pneumatic cylinder, a base seat disposed on the pneumatic cylinder, the lower cover disposed on a bottom of the pneumatic cylinder, an oil tank disposed on the base seat, and an oil pump connected to the base seat. A handle is connected to the oil pump. A connector is connected to the lower cover. An air pipe is connected to the connector. An air pressure valve is connected to the air pipe.

2 Claims, 8 Drawing Sheets

OIL PRESSURE DEVICE

BACKGROUND OF THE INVENTION

The present invention relates to an oil pressure device. More particularly, the present invention relates to an oil pressure device which is disposed on a hoist frame.

Referring to FIG. 8, a conventional oil pressure pump 60; is disposed on a hoist frame 10. The hoist frame 10 has an upper panel 40 and a middle panel 20. An oil cylinder 50 is disposed on the upper panel 40. A mold 501 is disposed on a bottom of the upper panel 40. Two mounts 30 are disposed on the middle panel 20. A working piece 70 is disposed on the mounts 30. A handle 601 is connected to the oil pressure pump 60. An oil pipe 80 is connected to the oil pressure pump 60 and the oil cylinder 50. The handle 601 should be operated manually.

SUMMARY OF THE INVENTION

An object of the present invention is to provide an oil pressure device which is operated easily.

Accordingly, an oil pressure device is disposed on a hoist frame. The hoist frame has an upper panel and a middle panel. An oil cylinder is disposed on the upper panel. A mold is disposed on a bottom of the upper panel. Two mounts are disposed on the middle panel. The oil pressure device comprises a pneumatic pump having a lower cover and a pneumatic cylinder, a base seat disposed on the pneumatic cylinder, the lower cover disposed on a bottom of the pneumatic cylinder, an oil tank disposed on the base seat, and an oil pump connected to the base seat. The oil pump has a piston shaft. A handle is connected to the piston shaft. The base seat has an oil sucking channel. An oil pipe is connected to the base seat and the oil cylinder. The oil pipe communicates with the oil sucking channel of the base seat. The lower cover has a guide channel, a valve plug, a through aperture for receiving the valve plug, an inner chamber, an inlet channel, an outlet channel, a plurality of vent holes communicating with the outlet channel, and a valve piston disposed in the inner chamber. The pneumatic cylinder has an inner pump connected to the base seat, a piston rod passing through the inner pump, a pneumatic piston connected to the piston rod, and a spring surrounding the inner pump and the piston rod.

DETAILED DESCRIPTION OF THE INVENTION

Figure 1:
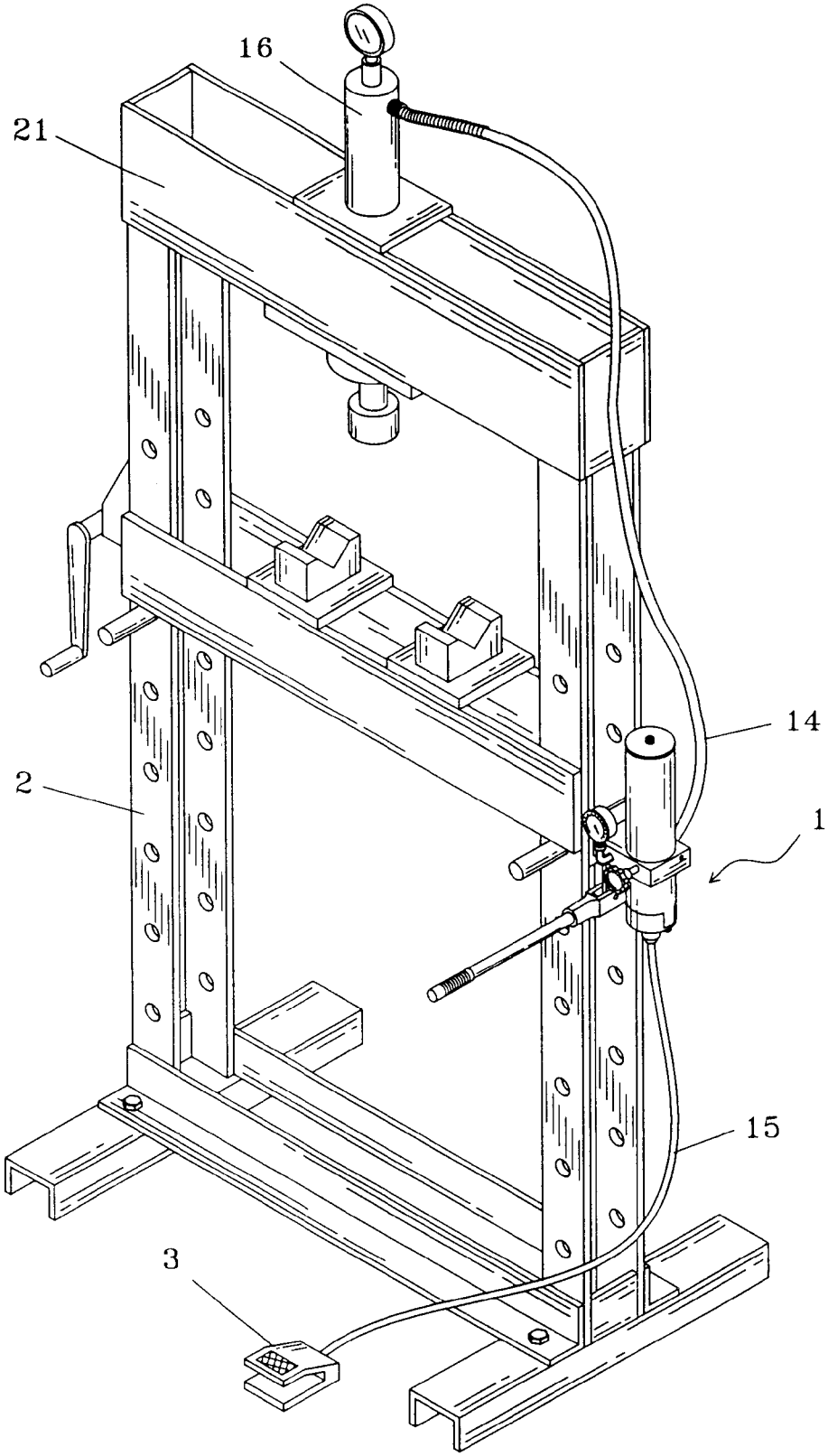
FIG. 1 is a perspective view of a hoist frame of a preferred embodiment in accordance with the present invention.
Figure 2:
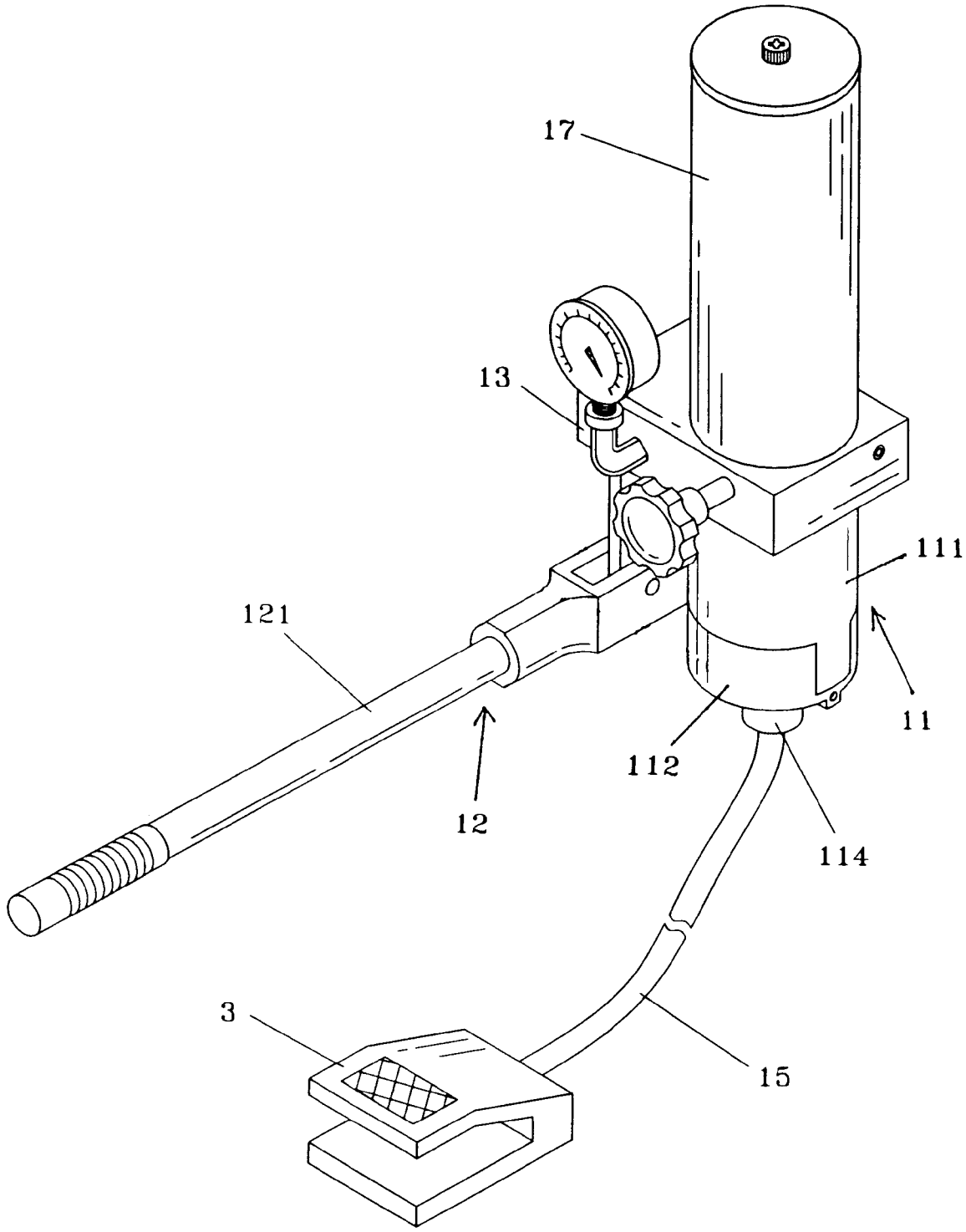
FIG. 2 is a perspective view of an oil pressure device of a preferred embodiment in accordance with the present invention.
Figure 3:
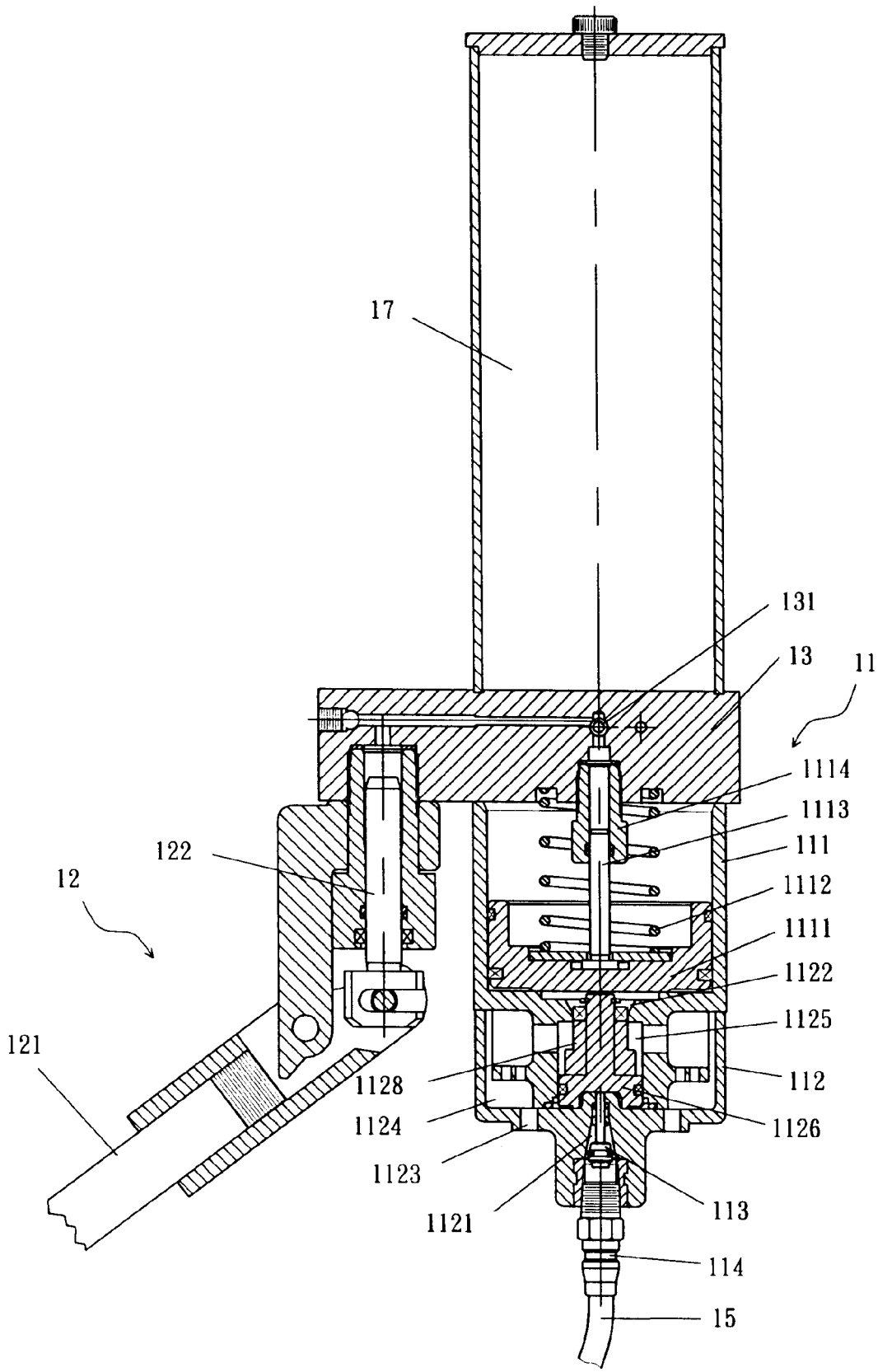
FIG. 3 is a sectional view of an oil pressure device of a preferred embodiment in accordance with the present invention.
Figure 4:
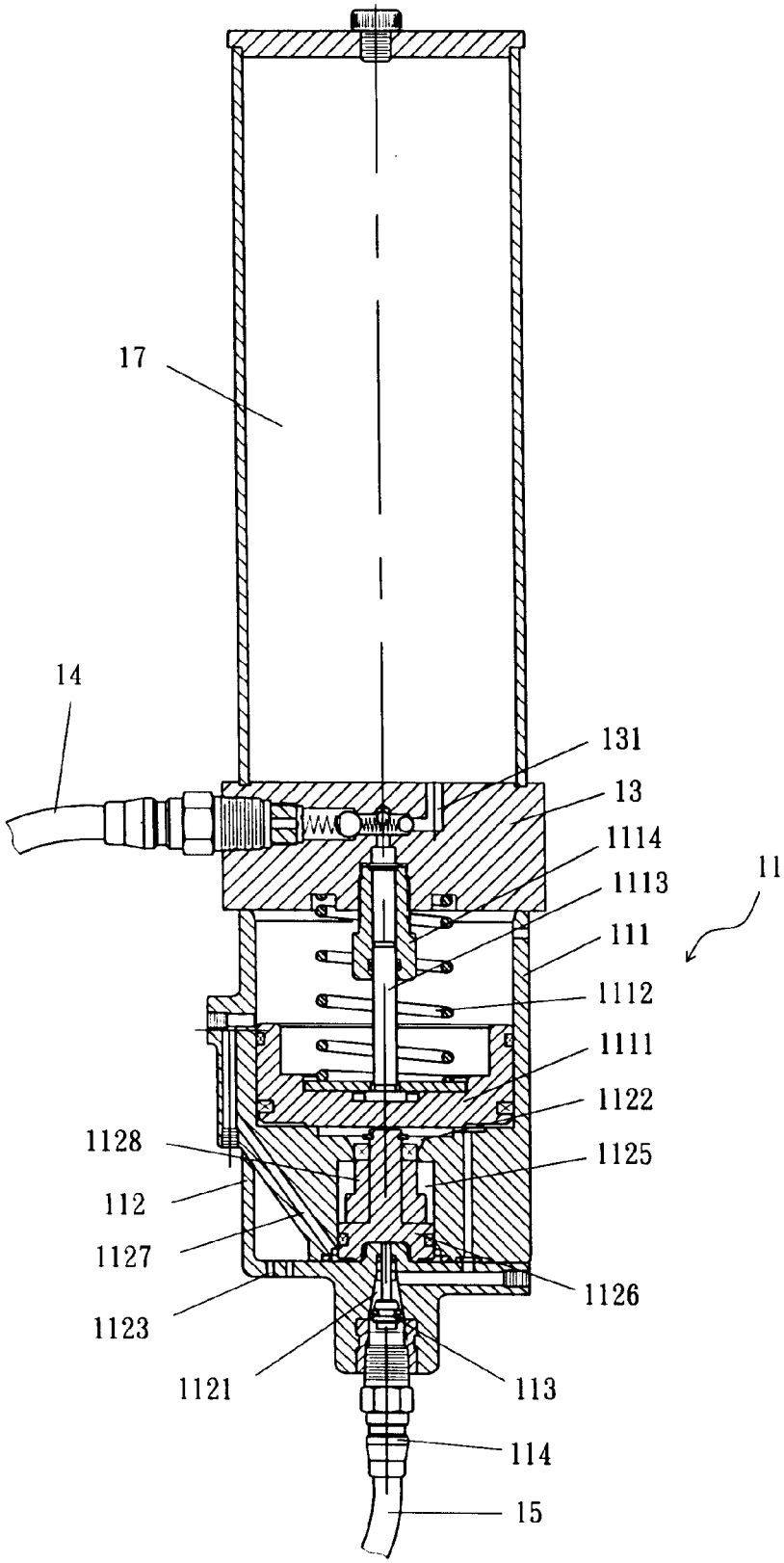
FIG. 4 is another sectional view of an oil pressure device of a preferred embodiment in accordance with the present invention.
Figure 5:
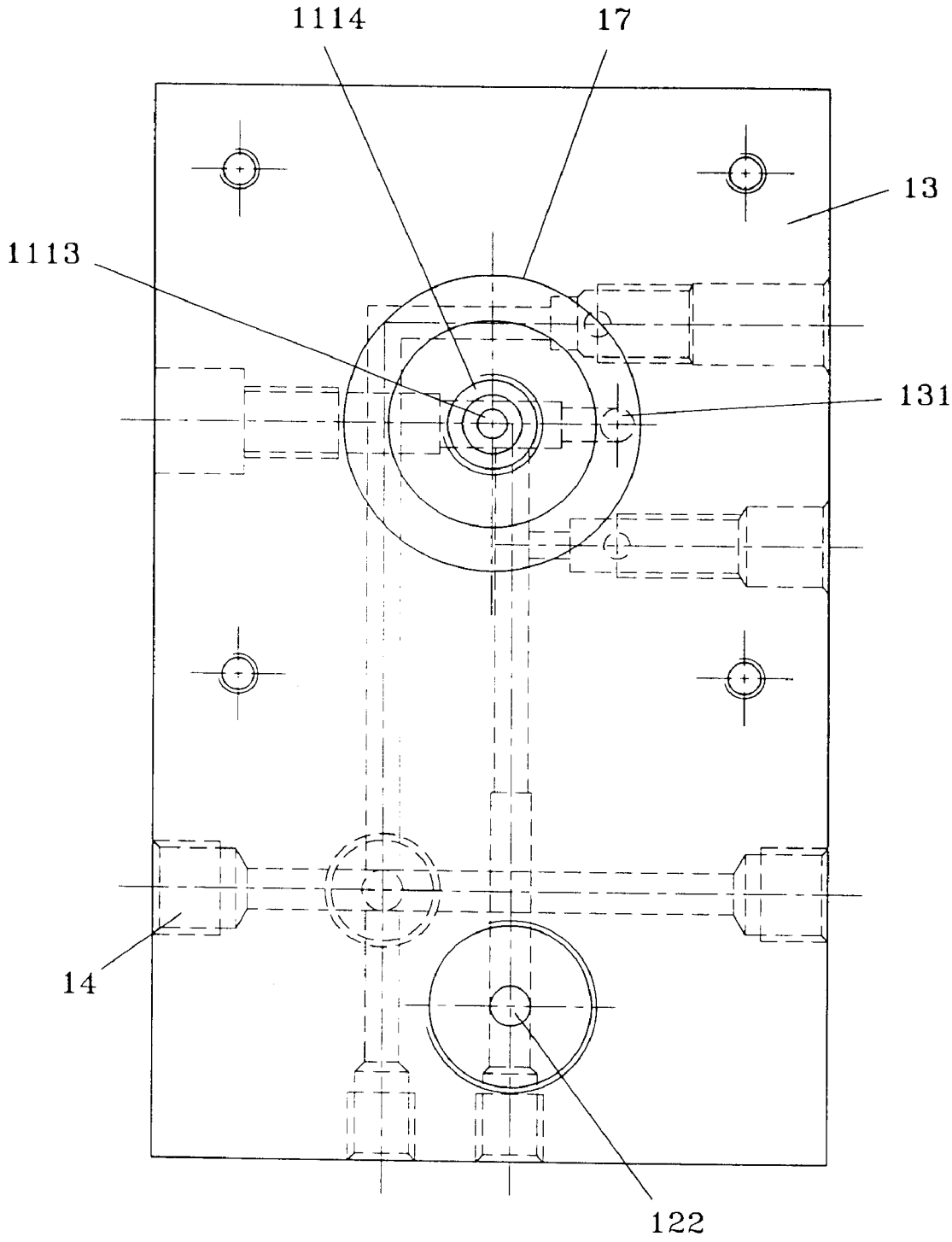
FIG. 5 is a bottom plan view of an oil pressure device of a preferred embodiment in accordance with the present invention.
Figure 6:
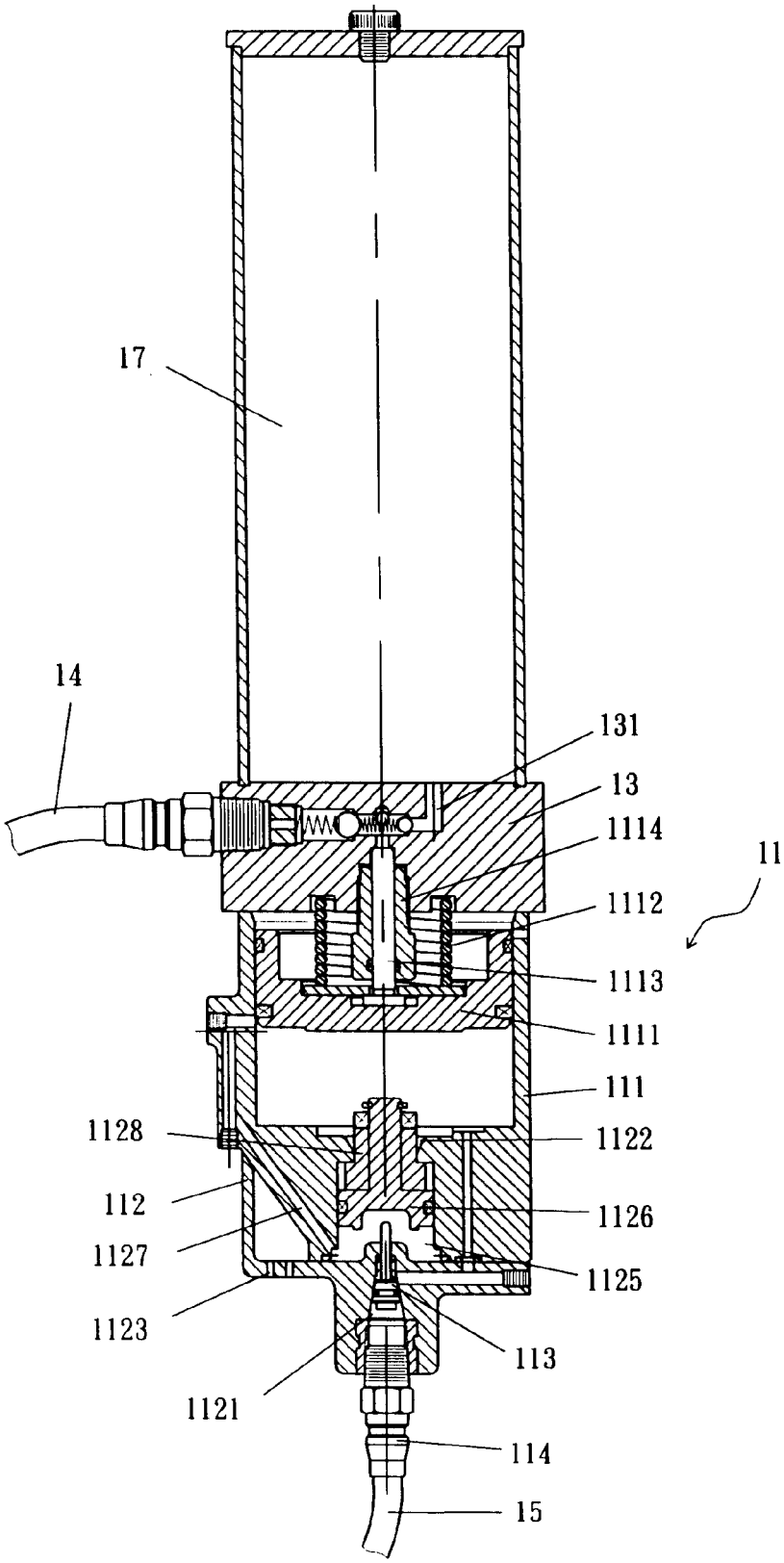
FIG. 6 is a sectional schematic view illustrating an operation of an oil pressure device of a preferred embodiment in accordance with the present invention.

Referring to FIGS. 1 to 7, an oil pressure device 1 is disposed on a hoist frame 2. The hoist frame 2 has an upper panel 21 and a middle panel 22. An oil cylinder 16 is disposed on the upper panel 21. A mold 24 is disposed on a bottom of the upper panel 21. Two mounts 23 are disposed on the middle panel 22. A working piece 18 is disposed on the mounts 23.

The oil pressure device 1 comprises a pneumatic pump 11 having a pneumatic cylinder 111 and a lower cover 112 mounted on a bottom of the pneumatic cylinder 111, a base seat 13 mounted on a top of pneumatic cylinder 111, an oil tank 17 mounted on a top of the base seat 13, and an oil pump 12 connected to the base seat 13.

The oil pump 12 has a piston shaft 122. A handle 121 is connected to the piston shaft 122.

The base seat 13 has an oil sucking channel 131. An oil pipe 14 is connected to the base seat 13 and the oil cylinder 16. The oil pipe 14 communicates with the oil; sucking channel 131 of the base seat 13.

The lower cover 112 has a guide channel 1127, a valve plug 113, a through aperture 1121 for receiving the valve plug 113, an inner chamber 1125, an inlet channel 1122, an outlet channel 1124, a plurality of vent holes 1123 communicating with the outlet channel 1124, and a valve piston 1126 disposed in the inner chamber 1125.

The pneumatic cylinder 111 has an inner pump 1114 connected to the base seat 13, a piston rod 1113 passing through the inner pump 1114, a pneumatic piston 1111 connected to the piston rod 1113, and a spring 1112 surrounding the inner pump 1114 and the piston rod 1113.

A connector 114 is connected to the lower cover 112. An air pipe 15 is connected to the connector 114. An air pressure valve 3 is connected to the air pipe 15.

The valve piston 1126 has a plurality of rib plates 1128.

When the air pressure valve 3 is operated, air will, enter the air pipe 15, the connector 114, and the through aperture 1121 of the lower cover 112.

The piston rod 1113 pushes the valve piston 1126 to move forward. The air enters the inlet channel 1122 and the pneumatic piston 1111 moves forward. Then the guide channel 1127 communicates with the inner chamber 1125. The air in the pneumatic cylinder 111 exhales from the inner chamber 1125 to the outlet channel 1124 and to the vent holes 1123. Then the spring 1112 is compressed.

When the spring 1112 expands, the valve piston 1126 moves rearward. The valve piston 1126 pushes the piston rod 1113 to move rearward. Then the inlet channel 1122 communicates with the through aperture 1121 of the lower cover 112.

Figure 7:
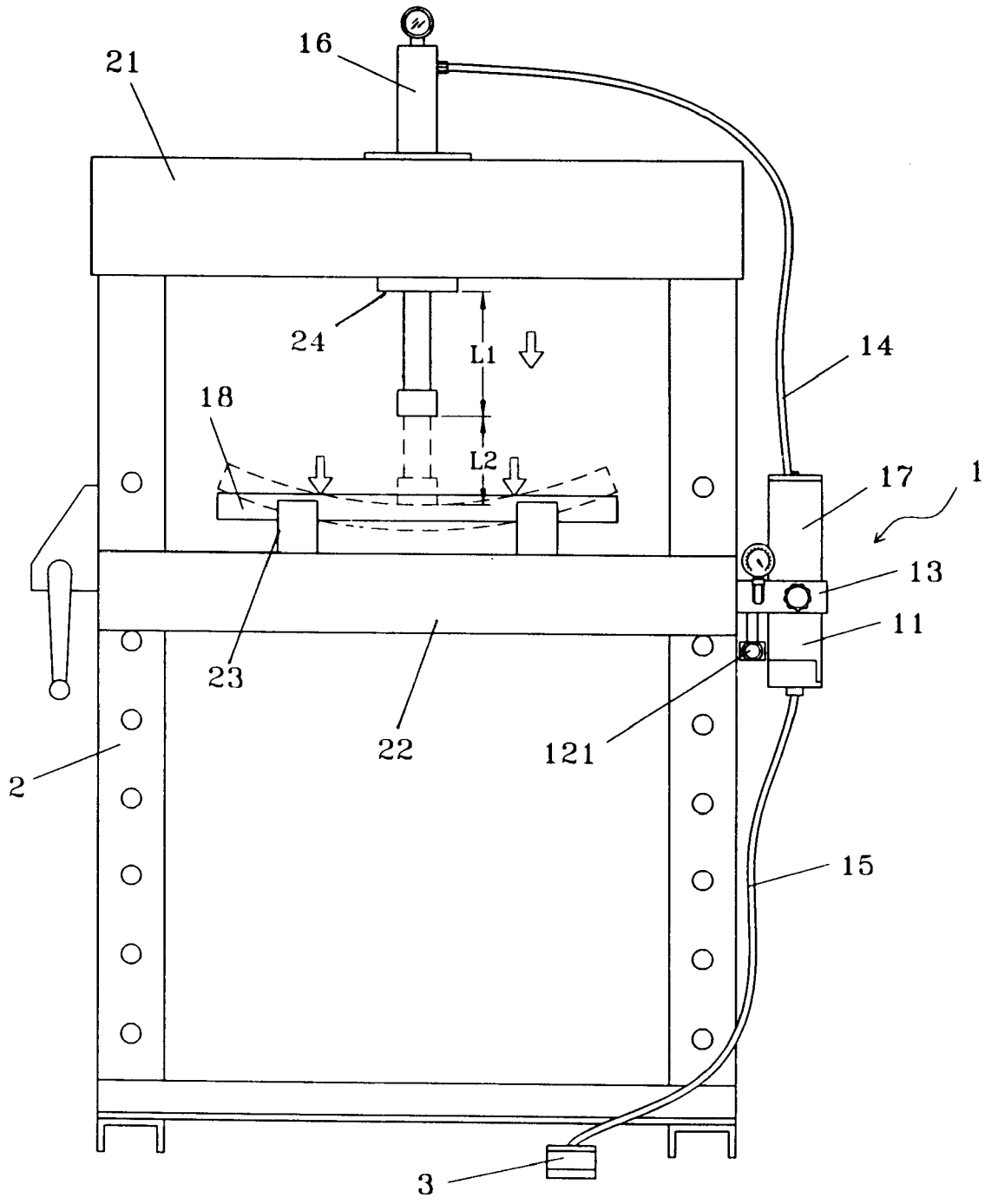
FIG. 7 is an elevational view of a hoist frame of a preferred embodiment in accordance with the present invention.
Figure 8:
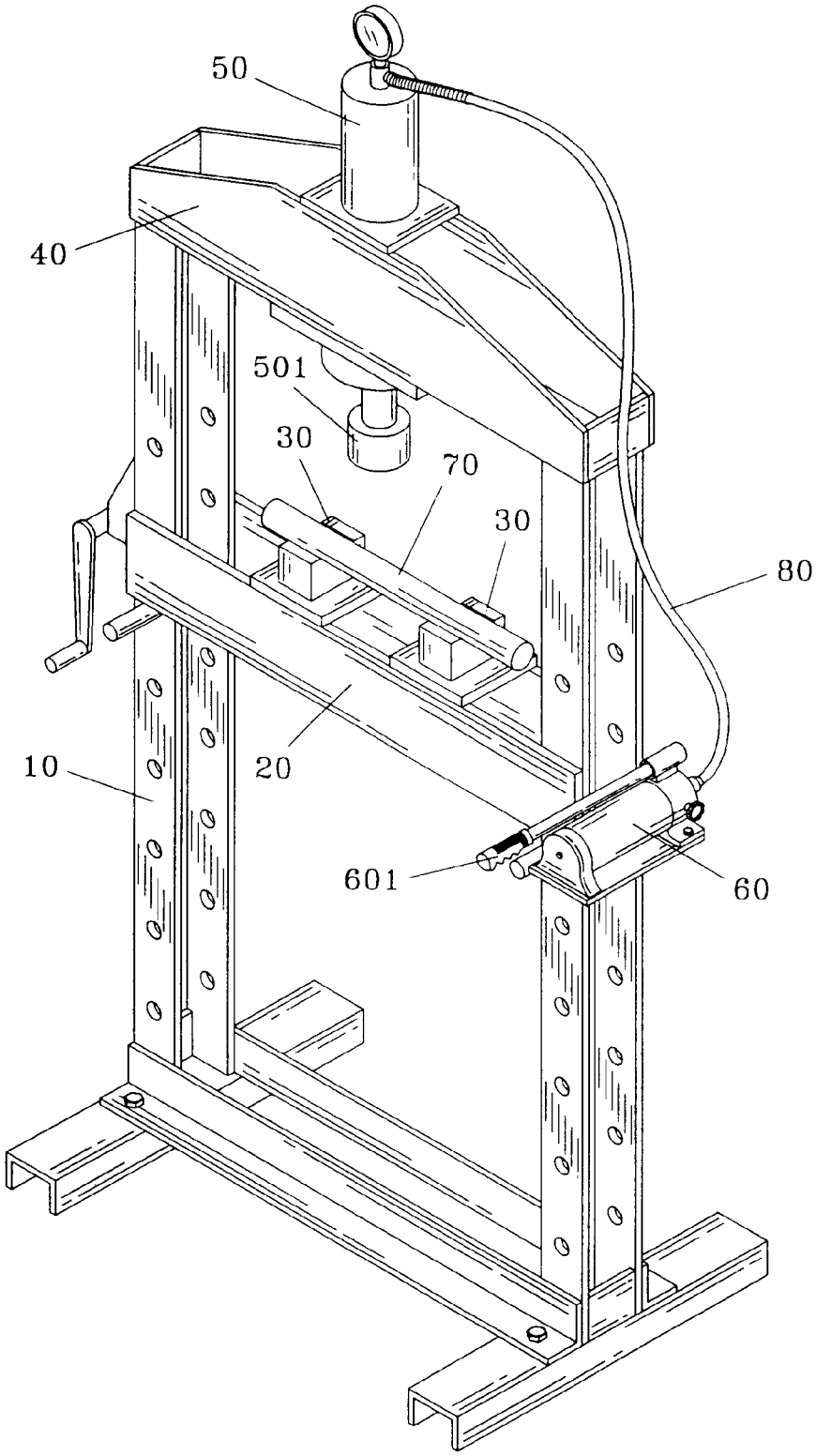
FIG. 8 PRIOR ART
FIG. 8 is a perspective view of a hoist frame of the prior art.

When the handle 121 is operated, the oil will flow from the oil. tank 17 to the oil sucking channel 131 of the base seat 13, to the oil pipe 14, and to the oil cylinder 16. The length L1 of oil cylinder 16 will be extended to an additional length L2 (as shown in FIG. 7). Therefore, the oil pressure device 1 is operated easily.

The present invention is not limited to the above embodiment but various modification thereof may be made. Furthermore, various changes in form and detail may be made without departing from the scope of the present invention.

I claim:

1. An oil pressure device disposed on a hoist frame, the hoist frame having an upper panel and a middle panel, an oil cylinder disposed on the upper panel, a mold disposed on a bottom of the upper panel, two mounts disposed on the middle panel, and the oil pressure device comprising a pneumatic pump having a lower cover and a pneumatic cylinder, a base seat disposed on the pneumatic cylinder, the lower cover disposed on a bottom of the pneumatic cylinder, an oil tank disposed on the base seat, and an oil pump connected to the base seat, the oil pump having a piston shaft, a handle connected to the piston shaft, the base seat having an oil sucking channel, an oil pipe connected to the base seat and the oil cylinder, the oil pipe communicating with the oil sucking channel of the base seat, the lower cover having a guide channel, a valve plug, a through aperture for receiving the valve plug, an inner chamber, an inlet channel, an outlet channel, a plurality of vent holes communicating with the outlet channel, and a valve piston disposed in the inner chamber, and the pneumatic cylinder having an inner pump connected to the base seat, a piston rod passing through the inner pump, a pneumatic piston connected to the piston rod, and a spring surrounding the inner pump and the piston rod.

2. The oil pressure device as claimed in claim 1, wherein a connector is connected to the lower cover, an air pipe is connected to the connector, and an air pressure valve is connected to the air pipe.

* * * * *